US007591105B2

(12) United States Patent
Balser

(10) Patent No.: US 7,591,105 B2
(45) Date of Patent: Sep. 22, 2009

(54) ATTIC STORAGE SYSTEM AND METHOD

(76) Inventor: Gerald G. Balser, P.O. Box 973, Tellico Plains, TN (US) 37385

( * ) Notice: Subject to any disclaimer, the term of this patent is extended or adjusted under 35 U.S.C. 154(b) by 342 days.

(21) Appl. No.: 11/149,607

(22) Filed: Jun. 10, 2005

(65) Prior Publication Data

US 2006/0277832 A1 Dec. 14, 2006

(51) Int. Cl.
*B66B 9/00* (2006.01)

(52) U.S. Cl. ..... 52/29; 52/66

(58) Field of Classification Search ..... 52/29, 52/64, 66; 312/246; 211/144; 414/331.03, 414/331.06, 429; 193/35 B, 35 R, 37
See application file for complete search history.

(56) References Cited

U.S. PATENT DOCUMENTS

| | | | | |
|---|---|---|---|---|
| 3,942,814 | A * | 3/1976 | Buhler | 280/79.11 |
| 4,446,660 | A | 5/1984 | Miller et al. | |
| 4,597,615 | A * | 7/1986 | Steger | 312/201 |
| 4,699,437 | A | 10/1987 | Genereaux | |
| 4,773,546 | A * | 9/1988 | Konstant | 211/151 |
| 4,982,851 | A * | 1/1991 | Konstant | 211/151 |
| 5,056,642 | A * | 10/1991 | Highsmith | 193/35 R |
| 5,136,751 | A * | 8/1992 | Coyne et al. | 16/29 |
| 5,180,069 | A * | 1/1993 | Krummell et al. | 211/151 |
| 5,239,790 | A | 8/1993 | Fetzer | |
| 5,242,219 | A | 9/1993 | Tomaka | |
| 5,285,909 | A * | 2/1994 | Slater | 211/151 |
| 5,312,004 | A * | 5/1994 | Krummell et al. | 211/151 |
| 5,595,028 | A | 1/1997 | Handzlik | |
| 5,628,153 | A | 5/1997 | Fontanez | |
| 5,649,751 | A | 7/1997 | Longhurst | |
| 5,845,979 | A | 12/1998 | Longhurst et al. | |
| 6,027,190 | A * | 2/2000 | Stewart et al. | 312/201 |
| 6,202,359 | B1 | 3/2001 | Reed | |
| 6,354,682 | B1 | 3/2002 | Nott et al. | |
| 6,550,878 | B2 | 4/2003 | Nott et al. | |
| 6,681,702 | B1 * | 1/2004 | Nicely | 105/157.1 |
| 2002/0070092 | A1 * | 6/2002 | Ransil | 193/37 |
| 2005/0016098 | A1 | 1/2005 | Hahn | |

* cited by examiner

*Primary Examiner*—Basil Katcheves
(74) *Attorney, Agent, or Firm*—Pitts & Brittian, P.C.

(57) ABSTRACT

An attic storage system comprising a series of elongated rails, each including an array of rollers mounted in and along the length of each rail at spaced apart locations. Individual storage containers, provided with bottom support means adapted to ride along the length of the rails are carried by the rails. The rails of the present invention are adapted to be mounted atop the upper surface of two or more of the ceiling joists of the attic. Thus, the rails may be mounted parallel to, angular to, or perpendicular to, the length dimension of the ceiling joints, thereby providing for enhanced variability in the positioning of the operative elements of the system within an attic, hence enhanced accessibility to any given one or more of the storage containers.

3 Claims, 6 Drawing Sheets

ATTIC STORAGE SYSTEM AND METHOD

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to systems for storage of items within the attic of a house, garage, or like structure having a rafter-type construction wherein there is open space between the ceiling joists and the rafters of the structure or other location such as in the void space beneath a stairway.

BACKGROUND OF THE INVENTION

Attic space has long been used for the storage of items which are being retained for future use, or for periodic use, or even permanent storage. Several systems have been devised for use of such attic space for storage. Certain of these systems utilize only the spacing between adjacent ceiling joists, hence are severely limited in their utility, particularly with respect to the size of the items desired to be stored. That is, in these systems, where the ceiling joists are 2×6 inch boards spaced apart by 18 or 24 inches, only items which will fit between the ceiling joists may be stored in these prior art systems. In these systems, if a cover for the stored item is desired, the stored item can have a thickness of less than 6 inches.

In the foregoing, and similar storage systems, advantage can not be taken of the void between the top edge of the ceiling joists and the rafters, for example. More importantly, these prior art systems consume the space between ceiling joists where more desirably thermal insulation is provided. Still further, such systems are limited to movement, if any, of the storage containers of the system in a direction parallel with the ceiling joists, thereby limiting accessibility to the individual storage containers.

BRIEF SUMMARY OF THE INVENTION

In accordance with the present invention, there is provided an attic storage system comprising a series of elongated rails, each including an array of rollers mounted in and along the length of each rail at spaced apart locations. Individual storage containers, provided with bottom support means adapted to ride along the length of the rails. The rails of the present invention are adapted to be mounted atop the upper surface of two or more of the ceiling joists of the attic. Thus, the rails may be mounted parallel to, angular to, or perpendicular to, the length dimension of the ceiling joints, thereby providing for enhanced variability in the positioning of the operative elements of the system within an attic, hence enhanced accessibility to any given one or more of the storage containers.

In one embodiment of the present invention, the rails of the system are mounted to the side of a ceiling joist with the rollers exposed at a vertical level above the top surface of the joists. In this embodiment, the rollers bedded in each rail are of the rotational omni-directional type, so that the storage containers are moved along the rails in any of several directions, or the storage containers are provided with guide means which limit their movement to a direction parallel to the length dimension of the ceiling joists which carry the rails. In each embodiment of the present invention, there is no material intrusion into the spacing between ceiling joists where desirably thermal insulation is provided.

DETAILED DESCRIPTION OF THE INVENTION

Figure 1:
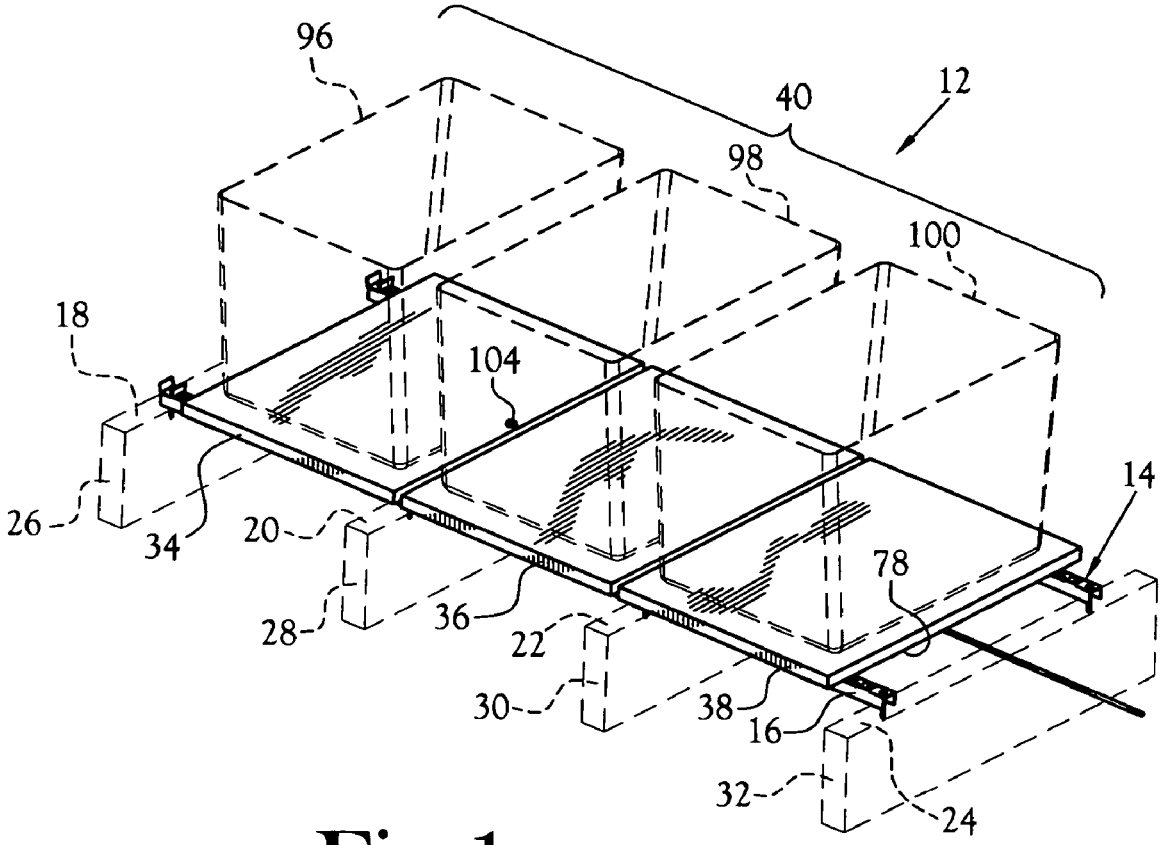
FIG. 1 is a schematic representation of one embodiment of the system of the present invention and depicting mounting of the rails of the system in a direction perpendicular to the length of the ceiling joints, among other things.

In accordance with one embodiment of the present invention as depicted in FIG. 1, the present storage system 12 for an enclosed area such as an attic, the area under a stairwell or the like, includes first and second elongated rails 14 and 16 adapted to be mounted on the top surfaces 18, 20, 22 and 24 of a plurality of respective ceiling joists 26, 28, 30 and 32 to define a support for the receipt of a plurality of individual platform dollies 34, 36 and 38, which in turn receive storage containers 96 thereon for selective movement of the dollies, hence like movement of the storage containers 96, 98 and 100, for example, along the rails.

Figure 2:
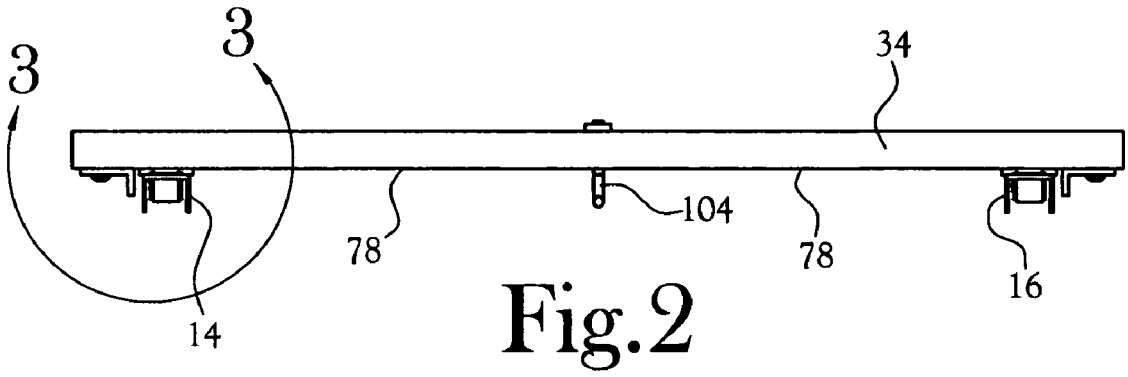
FIG. 2 is a rear end elevation view of a portion of a storage container mounted on a set of rails according to one embodiment of the present invention.
Figure 3:
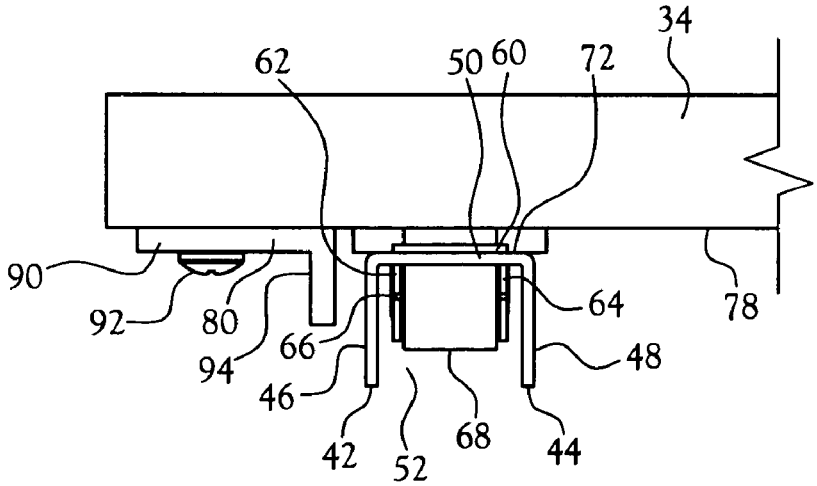
FIG. 3 is sectional view taken generally along the line 3-3 of FIG. 2.

Referring to FIGS. 2 and 3, each of the depicted rails is of an inverted "U" shape cross section with the outboard edges 42 and 44 of the opposite side walls 46 and 48, respectively, of the rail resting on the top surfaces of the ceiling joists, thereby positioning the base 50 of each rail in a plane which is parallel, but spaced vertically above the top surface of each ceiling joist. This geometry of the rail establishes an open space 52 between the base of the rail and the top surface of the ceiling joist. Notably, this mounting of the rails on the top surfaces of the ceiling joists, leaves void the space between adjacent ceiling joists for the receipt of insulation or the like. This feature of the present invention further provides sufficient clearance between the dolly 34 mounted on the rollers and the top surfaces of the ceiling joists as permits the overflow of insulation across the top surfaces of the ceiling joist thereby enhancing the insulative value of the insulation.

As depicted in the several Figures, the base of each of the depicted rails is provided with a plurality of elongated openings 56, for example, defined through the thickness of the base of the rail at spaced apart locations along the length of each rail.

In the depicted embodiment, (see FIGS. 2-4) each roller 68 is a "self-contained" roller unit 58 comprising a mounting plate 60 having dependent oppositely disposed parallel side plates 62 and 64 depending from the opposite side edges of the mounting plate 60. These side plates are bored to provide openings for the receipt of an axle 66 for a roller disposed between the side plates. Further, the mounting plate includes an opening 70 through the thickness thereof and through which less than about one-half of the diameter of a respective roller projects. In turn, each roller unit is aligned with a respective opening 56 (see FIG. 4) through the base of a rail with the mounting plate 60 of the unit resting on the top outer surface 72 of the rail and with the side walls disposed substantially within the void space defined by the base of the rail, its side walls and the top surface of a ceiling joist. When so positioned, less than about one-half of the diameter of the roller projects above and beyond the base of the rail in position to support a storage container thereupon. The remaining portion of each roller thus is disposed within the void space defined between the rail and the top surface of a ceiling joist. Mounting of the individual mounting plates with their respective rollers may be by means of screws 76 or other suitable attachment means. Preferably, the individual roller units are spaced apart from one another along their respective rail by a distance, and the width dimension of each dolly is selected, such that each dolly is at all times in supporting engagement with at least two roller units of each rail at any given position of the dolly along the length of its two associated rails, thereby by ensuring that the dolly is maintained horizontal as it is moved along its supporting rails. However, in accordance with the present invention, the combination of the flat top surface of each rail and the limited degree of exposure of each roller above and beyond the top flat surface of its respective rail minimizes any tilt of a dolly as it is moved along its supporting rails. Should, however, a dolly tilt as it is being moved along its supporting rails, the leading marginal edge of the dolly will engage and slide along the flat top surface of its supporting rails and, due to the limited exposure of the roller above and beyond the flat top surface of the rails, will merely ride onto and over such rollers to return the dolly to its desired horizontal orientation. This recovery action by a dolly is enhanced by reason of the limited exposure of each roller above and beyond the top flat surface of the supporting rails, hence the minimal distance between the bottom surface 78 of the dolly and the flat top surface of the supporting rails.

In one embodiment of the present system, each dolly of the system may be of a width such that its opposite ends are flush with an outboard side of those ceiling joists on which a set of rails is mounted. This embodiment of the dolly leaves the space between adjacent ceiling joists (other then those ceiling joists upon which the rails are mounted) fully free of any obstruction contributed by the present system. However, if desired, the width dimension of one or more of the dollies may be chosen such that the opposite ends of the dolly projects laterally and beyond the outboard sides of those ceiling joists on which a set of rails is mounted to provide additional supporting surface area for the dolly as depicted in FIG. 1.

Retention of each dolly on it respective set of rails is provided by means of channel segments 80 of "L" shape cross section (FIGS. 2 and 3). In one embodiment, one such channel segment is provided at each of the four corners 82-88 of the under side surface of each dolly. The orientation of each channel segment is chosen to cause a first leg 90 of the channel member to underlie the bottom surface of the dolly and be mounted thereto as by screws 92 or other suitable fastener means. Further, this orientation exposes a second leg 94 of the segment in facing and adjacent relationship to the side wall of a respective rail upon which the dolly is supported. Thus, the four channel segments function to maintain the dolly aligned with the rails for ready progression of the dolly along such rails, and to preclude the dolly from becoming dislodged from its respective rails.

As seen in FIG. 1 a plurality 40 of storage containers 96-100 (shown in phantom) may be disposed on the dollies of the present system. By design, the present invention provides for these storage containers to be supported fully outside the space between adjacent ceiling joints and with no portion of the storage container being in engagement with a ceiling joist.

In the depicted embodiment, one storage container is disposed on each dolly. It will be recognized that a storage container may be so large as to overlie multiple ones of the dollies, or multiple smaller storage containers may be stacked on a single dolly.

Figure 7:
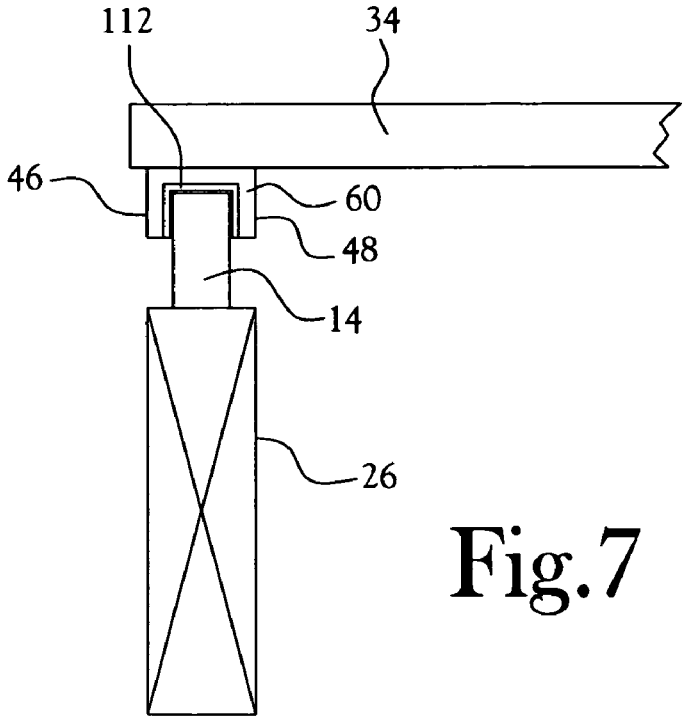
FIG. 7 is a schematic representation of an embodiment of the present invention employing sliding surfaces in lieu of roller units.

Referring to FIG. 7, optionally, it is contemplated that a sliding-type mounting of the individual dollies on the rail 14 may be employed. For example, as depicted in FIG. 7, each dolly 34 may be provided with a U-shaped mounting plate 60 extending from each of the four corners of the dolly with the "U" positioned such that it opens downwardly to receive a rail 14 between the opposite legs 46 and 48 of the bracket. The inner surface of the bracket preferably is coated with a friction-resistant coating 112 to promote ready sliding movement of the bracket, hence the dolly, along the rail. Alternatively, the rail also may be coated with a friction-resistant material, such as a polymeric material, to further enhance the ready an easy sliding of each dolly along its set of rails.

Figure 4:
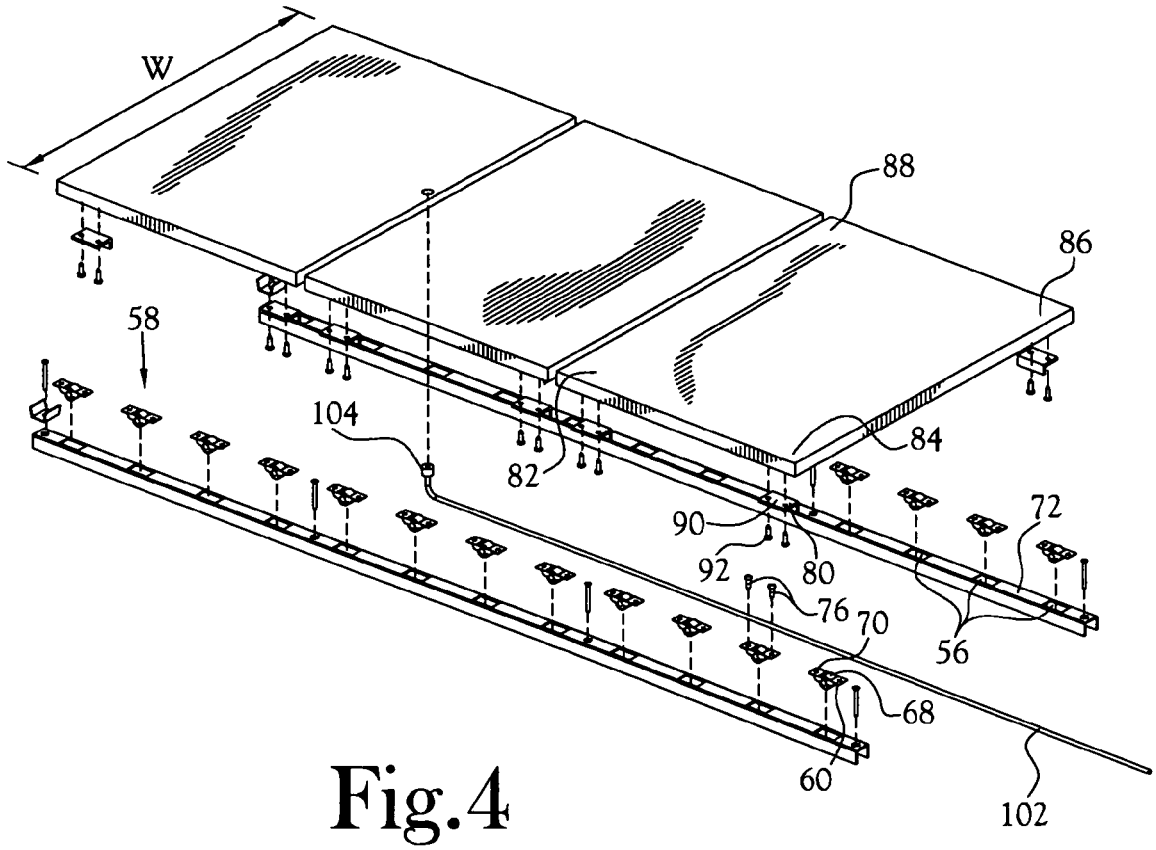
FIG. 4 is an exploded view of one embodiment of the present invention and depicting various of the components of the present invention and their respective relationships to one another.

Referring to FIGS. 1 and 4, in particular, in the present invention, each dolly is a singular unit in that it is not affixed to an adjacent dolly and its movement along its supporting rails depends upon an external force being applied to the dolly to urge it along its supporting rails. In the depicted embodiment, movement of the dollies collectively along their supporting rails may be effected by means of a rope 102 or the like which has one end thereof affixed to a post 104 which is affixed to the bottom surface of that dolly which is outboard of a plurality of side-by-side aligned dollies on a given set of rails. This rope leads from this point of affixation underneath the array of dollies to a location adjacent that dolly which is most distant from the dolly to which the rope is affixed, thereby being in position to be grasped by a user. Pulling on the rope thus moves all the dollies simultaneously toward the user whereupon one or more storage containers may be retrieved from its dolly or one or more stored items may be retrieved from a given storage container. As desired, one or more of the dollies may be added or removed from a given array of dollies to change the overall storage capacity of the system. Reversal of movement of the dollies along their supporting set of rails may be accomplished by merely pushing against that dolly of the array which is most proximate the user.

Figure 5:
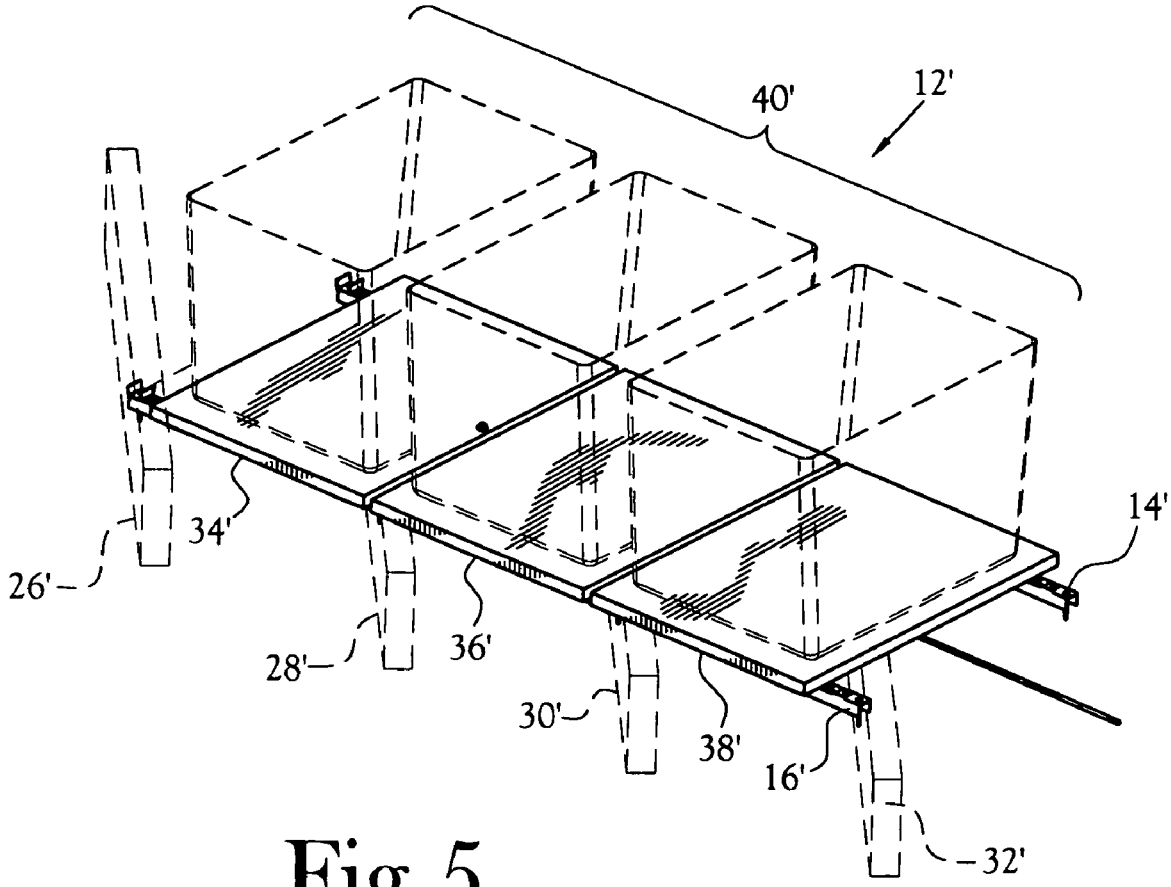
FIG. 5 is a schematic representation of a further embodiment of the present invention wherein the system is oriented angularly with respect to supporting ceiling joists.

With reference to FIG. 5, in a further embodiment of the present invention, the rails 14' and 16' of a given storage system 12' may be oriented angularly with respect to a plurality of supporting ceiling joists 26'-32', as opposed to alignment of the rails parallel to their supporting joists. In this latter embodiment, it may be possible to provide a plurality of storage systems within an attic with the rails of each storage systems terminating at a relative common location, such as adjacent a common "pull down" ladder provided in the ceiling of a residence or other structure. In this embodiment, the multiple arrays 40' of dollies 34'- 38' may emanate from the pull-down ladder in any of several angularly related directions, with all the arrays terminating at a common location for ease of access, without the user fully entering the attic, for example.

Figure 6:
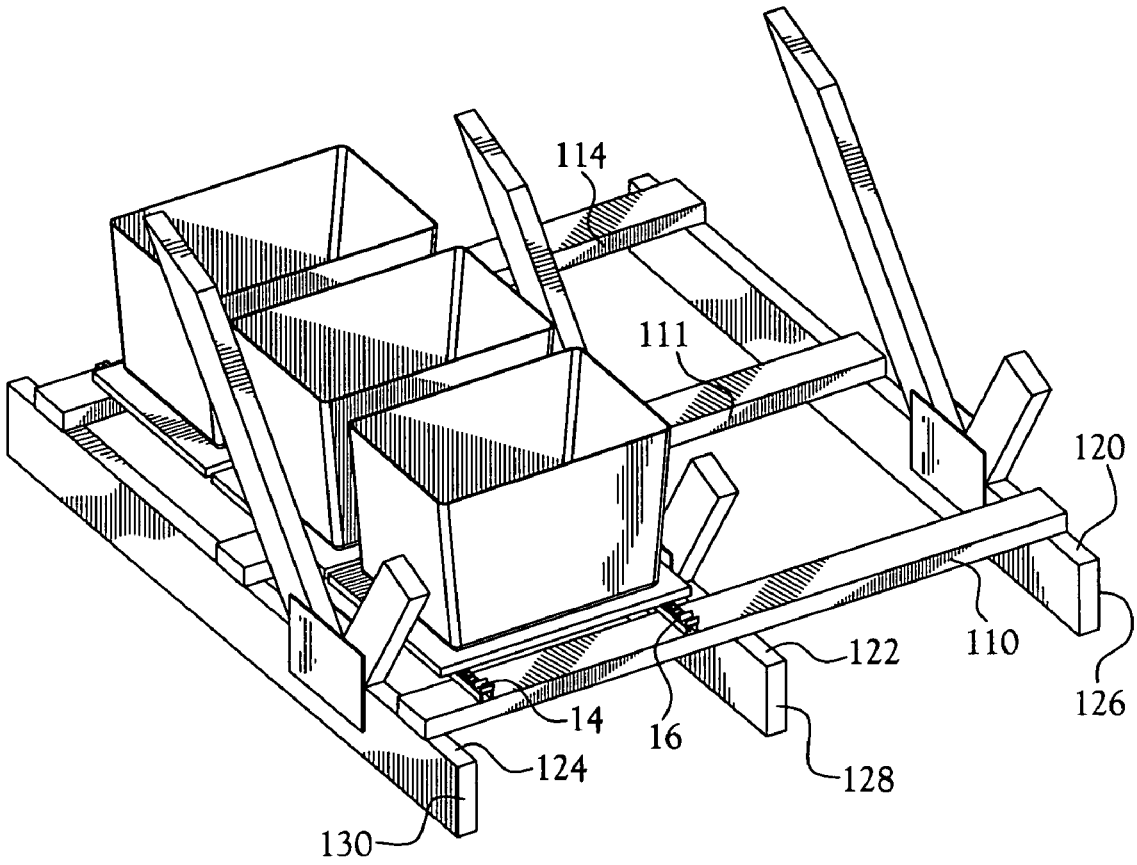
FIG. 6 is a schematic representation of a still further embodiment of the present invention wherein the system is mounted on boards overlaid on top of the ceiling joists and oriented substantially perpendicular to the length of the joists.

Referring to FIG. 6, in one embodiment of the present invention, a plurality of boards 110, 111 and 114, for example, are overlaid flat onto the top surfaces 120, 122, and 124 of adjacent ones 126, 128, and 130, for example, of the ceiling joists. In this embodiment, the rails 14 and 16 of the present invention are mounted on top of these boards, as opposed to being mounted directly onto the top surfaces of the ceiling joists. In this embodiment, it is possible to orient the rails parallel to the ceiling joists. It is to be noted, however, that the rails and their accompanying dollies are disposed above and beyond the plane occupied by the top flat surfaces of the ceiling joists, there by retaining the dollies outside the space between adjacent ones of the ceiling joists. This embodiment of the present invention permits an array of storage containers on a given set of rails to be disposed between the upright braces of adjacent ones of the ceiling trusses, thereby permitting utilization of the open attic space in the proximity of the eves of the roof structure.

Figure 8:
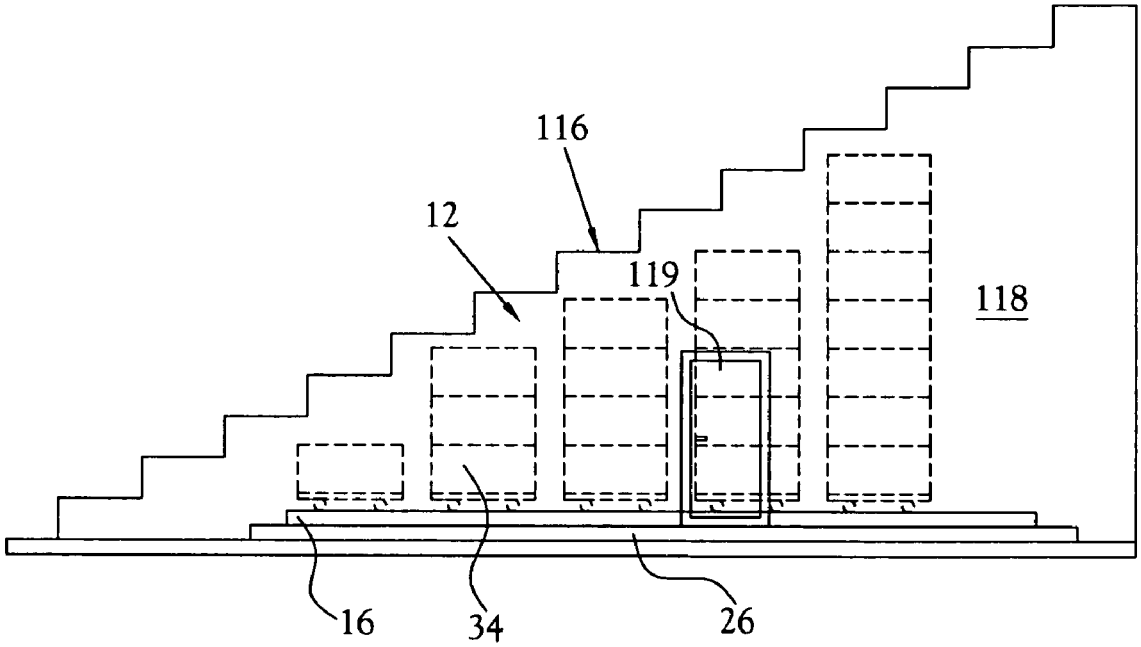
FIG. 8 is a schematic representation of a storage unit disposed in the void space beneath the steps of a stairway.

As seen in FIG. 8, in one embodiment of the present invention, the storage system may be disposed within the open space 118 beneath a set of steps 116 of a stairway accessible through the door 119. In this embodiment, a set of rails (only one rail shown in FIG. 7) of substantially the same construction as set forth in FIG. 3, 4 or 6, may be mounted on elongated parallel supports mounted on the floor underneath a set of steps. In this embodiment, a plurality of dollies mounted on this set of rails may be pulled or pushed, as needed, to move each of the dollies past a doorway through which access to the dolly and its contents may be accessed for unloading or loading items on the dolly. As desired, each dolly may be provided with a container for receiving items to be stored beneath the set of steps of the stairway. In this latter embodiment, as desired, one may substitute a furring strip on like elongated member for the joists upon which the rail is supported.

Whereas in the depicted embodiments, each of the rollers includes a transverse axle about which the roller rotates, thereby providing for rotation of each roller only within a single plane which is parallel to the length dimension of the rail, it will be recognized that each of the rollers may be mounted for universal rotation, as is well known in the conveyor art. This latter embodiment provides support for multi-directional movement of a storage container mounted on such rollers. When employing this latter embodiment of rollers, it may be desired to provide edge guides which limit the lateral movement of the storage containers to the extent that the storage containers do not move off their supporting rollers and become upset, with possible concomitant spillage of the item(s) contained within the storage container. Further, whereas the present invention has been described in terms of having dollies mounted on the rails, it will be recognized that instead of platform dollies, one skilled in the art would recognize that either open, partly open or closed containers could be substituted for the dollies, rather than being mounted upon the dollies.

Whereas various materials of construction have been noted for various components of the present invention, it will be recognized that a large variety of materials, metal, wood, polymeric, fiberglass, etc., may be employed in the manufacture of the various components of the present invention without deviation from the spirit of the invention.

What is claimed:

1. A storage system useful in an enclosed area having a plurality of substantially parallel spaced apart ceiling joists, each ceiling joist having a top upper surface, said storage system comprising:

first and second rails supported by the substantially top upper surfaces of respective ones of the ceiling joists, said rails being oriented substantially perpendicular to their respective underlying ceiling joists, each of said rails is of a generally U-shaped cross-section defined by a base having first and second opposite side edges, said base including first and second side walls depending from respective ones of said opposite side edges of said base, each of said first and second opposite side walls having an outboard edge, said outboard edges of said first and second side walls resting on the flat top surface of a respective one of the ceiling joists to define a void space between said base, said side walls and the flat top surface of a respective one of the ceiling joists, thereby positioning said rail fully above and beyond the flat top surface of the ceiling joists;

a plurality of rollers mounted at spaced apart locations along each of said first and second rails such that the respective location of each of said plurality of rollers is substantially fixed with respect to said first and second rails, said plurality of rollers being mounted within said void space at spaced apart locations along the length of each of said rails and axled between said first and second side walls of said base, each of said rollers being axled within said void space a distance of greater than about one-half the diameter of said roller whereby said roller protrudes from said void space above and beyond said base by a distance less than about one-half of the diameter of said roller; and one or more platform dollies adapted to be positioned on said rollers of said rails for reciprocatory movement of said dolly along said rails, each platform dolly mounted on said rails is fully above and beyond the flat top surfaces of the ceiling joists.

2. A storage system useful in an enclosed area having a plurality of substantially parallel spaced apart ceiling joists, each ceiling joist having a top upper surface, said storage system comprising:

first and second rails supported by the substantially top upper surfaces of respective ones of the ceiling joists, said rails being oriented substantially perpendicular to their respective underlying ceiling joists, each of said rails is of a generally U-shaped cross-section defined by a base having first and second opposite side edges, said base including first and second side walls depending from respective ones of said opposite side edges of said base, each of said first and second opposite side walls having an outboard edge, said outboard edges of said first and second side walls resting on the flat top surface of a respective one of the ceiling joists to define a void space between said base, said side walls and the flat top surface of a respective one of the ceiling joists, thereby positioning said rail fully above and beyond the flat top surface of the ceiling joists, said base of each of said rails is provided with an opening through the thickness thereof of a size sufficient to receive therethrough a portion of one of said rollers;

a plurality of rollers mounted at spaced apart locations along each of said first and second rails such that the respective location of each of said plurality of rollers is substantially fixed with respect to said first and second rails, said plurality of rollers being mounted within said void space at spaced apart locations along the length of each of said rails and axled between said first and second side walls of said base, each of said rollers being axled within said void space a distance of greater than about one-half the diameter of said roller whereby said roller protrudes from said void space above and beyond said base by a distance less than about one-half of the diameter of said roller; and one or more platform dollies adapted to be positioned on said rollers of said rails for reciprocatory movement of said dolly along said rails, each platform dolly mounted on said rails is fully above and beyond the flat top surfaces of the ceiling joists.

3. A storage system useful in an enclosed area having a plurality of substantially parallel spaced apart ceiling joists, each ceiling joist having a top upper surface, said storage system comprising:

first and second rails supported by the substantially top upper surfaces of respective ones of the ceiling joists, said rails being oriented substantially perpendicular to their respective underlying ceiling joists, each of said rails is of a generally U-shaped cross-section defined by a base having first and second opposite side edges, said base including first and second side walls depending from respective ones of said opposite side edges of said base, each of said first and second opposite side walls having an outboard edge, said outboard edges of said first and second side walls resting on the flat top surface of a respective one of the ceiling joists to define a void space between said base, said side walls and the flat top surface of a respective one of the ceiling joists, thereby positioning said rail fully above and beyond the flat top surface of the ceiling joists;

a plurality of rollers mounted at spaced apart locations along each of said first and second rails such that the respective location of each of said plurality of rollers is substantially fixed with respect to said first and second rails, said plurality of rollers being mounted within said void space at spaced apart locations along the length of each of said rails and axled between said first and second side walls of said base, each of said rollers being axled within said void space a distance of greater than about one-half the diameter of said roller whereby said roller protrudes from said void space above and beyond said base by a distance less than about one-half of the diameter of said roller, each of said rollers comprises a unit that includes a mounting plate having first and second side edges and first and second side plates depending from respective ones of said first and second side edges, said mounting plate being adapted to provide mounting of said units in register with a respective one of said openings defined in each of said rails with a major portion of said roller projecting into said void space between said rail and the top flat surface of a respective ceiling joist, and means axleing said roller between said first and second side plates; and one or more platform dollies adapted to be positioned on said rollers of said rails for reciprocatory movement of said dolly along said rails, each platform dolly mounted on said rails is fully above and beyond the flat top surfaces of the ceiling joists.

* * * * *